US009859689B1

(12) United States Patent
Sadaka

(10) Patent No.: US 9,859,689 B1
(45) Date of Patent: Jan. 2, 2018

(54) SPARK PLUG

(71) Applicant: NGK SPARK PLUG CO., LTD., Nagoya-shi, Aichi (JP)

(72) Inventor: Naoki Sadaka, Niwa-gun (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/618,806

(22) Filed: Jun. 9, 2017

(30) Foreign Application Priority Data

Jun. 14, 2016 (JP) ..... 2016-118159

(51) Int. Cl.

| | |
|---|---|
| ***H01T 13/39*** | (2006.01) |
| ***H01T 13/32*** | (2006.01) |
| ***H01T 13/36*** | (2006.01) |
| ***H01T 13/08*** | (2006.01) |
| *H01T 21/02* | (2006.01) |

(52) U.S. Cl.
CPC ..... *H01T 13/36* (2013.01); *H01T 13/08* (2013.01); *H01T 13/39* (2013.01); *H01T 13/32* (2013.01); *H01T 21/02* (2013.01)

(58) Field of Classification Search
CPC ..... H01T 13/36; H01T 13/08; H01T 13/39; H01T 13/32
See application file for complete search history.

(56) References Cited

U.S. PATENT DOCUMENTS 5,831,377 A * 11/1998 Matsubara ..... H01T 13/20 313/118
2007/0126330 A1* 6/2007 Kuki ..... H01T 13/16 313/143
2008/0054778 A1* 3/2008 Kumagai ..... H01T 13/36 313/143
2011/0181168 A1 7/2011 Nakamura et al.
(Continued)

FOREIGN PATENT DOCUMENTS

EP 2330702 A1 6/2011
EP 2876753 A1 5/2015
(Continued)

OTHER PUBLICATIONS

European Patent Office, Extended European Search Report issued in corresponding Application No. EP 17 17 5469, dated Nov. 10, 2017.

*Primary Examiner* — Mariceli Santiago
(74) *Attorney, Agent, or Firm* — Stites & Harbison, PLLC; Jeffrey A. Haeberlin

(57) ABSTRACT

In a cross section including a central axis, a value L/D obtained by dividing an axial length L of an overlap portion where a metal contact surface located on a metal shell and on which a packing is in contact with the metal shell overlaps a projection plane located on the metal shell and on which a contact surface located on an insulator and on which the packing is in contact with the insulator is projected in a direction orthogonal to the central axis by a difference D between a radius of an outer circumference of a tube portion at a connection position to a step portion and a radius of an
(Continued)

outer circumference of a leg portion at a connection position to the step portion is 1.2 or more. This ensures the force of constraint in the radial direction provided by the packing on the insulator.

5 Claims, 4 Drawing Sheets

(56) References Cited

U.S. PATENT DOCUMENTS

2012/0038263 A1* 2/2012 Katsuraya ..... H01T 13/20 313/144
2013/0015756 A1* 1/2013 Yamada ..... H01T 13/36 313/143
2013/0147339 A1* 6/2013 Burrows ..... H01T 13/20 313/143
2013/0307403 A1* 11/2013 Henke ..... H01T 13/36 313/144
2015/0188293 A1* 7/2015 Ozeki ..... H01T 13/36 313/143
2015/0222095 A1* 8/2015 Kuki ..... H01T 13/20 313/141
2016/0218487 A1* 7/2016 Kobayashi ..... H01T 13/20
2016/0233648 A1 8/2016 Fukuzawa et al.
2017/0033538 A1 2/2017 Kobayashi et al.

FOREIGN PATENT DOCUMENTS

JP 2016-012410 A 1/2016
WO 2010/035717 A1 4/2010
WO WO 2010035717 A1 * 4/2010 ..... H01T 13/20
WO WO 2011125306 A1 * 10/2011 ..... H01T 13/36
WO 2013-167974 A1 11/2013
WO 2015-155927 A1 10/2015

* cited by examiner

SPARK PLUG

CROSS REFERENCE TO RELATED APPLICATION

The present application claims priority to Japanese Patent Application No. 2016-118159, which was filed on Jun. 14, 2016, the disclosure of which is herein incorporated by reference in its entirety.

BACKGROUND OF THE INVENTION

Field of the Invention

The present invention relates to spark plugs, and particularly relates to a spark plug that can suppress the eccentricity of an insulator relative to a metal shell.

Description of Related Art

In a spark plug used in an internal combustion engine, a ground electrode that opposes a center electrode is connected to a metal shell mounted to an outer circumference of an insulator for holding the center electrode (e.g., Patent Document 1). The spark plug causes spark discharge between the center electrode and the ground electrode, and ignites an air-fuel mixture exposed between the two electrodes, thereby forming a flame kernel. In recent years, there has been a demand for reduction in the diameter of the spark plug in terms of, for example, the design of the internal combustion engine.

RELATED ART DOCUMENT

Patent Document 1 is Japanese patent application laid-open number 2016-12410.

BRIEF SUMMARY OF THE INVENTION

However, as the diameter of the spark plug is reduced, the distance between the inner circumferential surface of the metal shell and the outer circumferential surface of the insulator is shortened. Accordingly, when the eccentricity of the insulator relative to the metal shell becomes prominent, discharge (hereinafter referred to as "side spark") between the metal shell (in particular, the vicinity of the front end) and the insulator may occur.

The present invention has been made to solve the above-described problem, and it is an object of the invention to provide a spark plug that can suppress the eccentricity of the insulator relative to the metal shell.

In order to achieve this object, according to a first aspect of the invention, a spark plug includes an insulator, a center electrode, a tubular metal shell, a packing, and a ground electrode. The insulator includes a cylindrical tube portion disposed along a central axis, a cylindrical leg portion having an outer diameter smaller than an outer diameter of the cylindrical tube portion, and a step portion having an outer circumferential surface communicating (i.e., connecting) an outer circumferential surface of the cylindrical leg portion with an outer circumferential surface of the cylindrical tube portion. The center electrode is disposed inward of the insulator along the central axis. The tubular metal shell includes a trunk portion disposed radially outward of the cylindrical tube portion of the insulator, and a ledge portion linked to and bulging (i.e., projecting) radially inward of a front end, in an axial direction, of the trunk portion, and including a rear end surface opposing the outer circumferential surface of the step portion of the insulator. The packing is disposed between the step portion and the ledge portion. The ground electrode is connected to the tubular metal shell and opposes the center electrode.

In a cross section including the central axis, a value L/D obtained by dividing an axial length L of an overlap portion by a difference D between a radius of an outer circumference of the cylindrical tube portion at a connection position to the step portion and a radius of an outer circumference of the cylindrical leg portion at a connection position to the step portion, is 1.2 or more. The overlap portion is a portion where a metal contact surface of the tubular metal shell on which the packing is disposed overlaps a projection plane located on the tubular metal shell where a contact surface of the insulator on which the packing is disposed is projected in a direction orthogonal to the central axis. "D" affects the pressure applied to the packing, and "L" affects the area of the packing that constrains the insulator. By satisfying $L/D \geq 1.2$, it is possible to ensure the force of constraint in the radial direction provided by the packing on the insulator, thus making it possible to achieve the effect of suppressing the eccentricity of the insulator relative to the metal shell.

According to a second aspect of the invention, in the packing of the spark plug, a first portion that is in contact with the rear end surface of the ledge portion of the tubular metal shell and the outer circumferential surface of the step portion of the insulator is disposed between the rear end surface and the outer circumferential surface, and a second portion that is in contact with an inner circumferential surface of the trunk portion of the tubular metal shell and the outer circumferential surface of the cylindrical tube portion of the insulator is disposed between the inner circumferential surface and the outer circumferential surface. A third portion is in contact with the outer circumferential surface of the cylindrical leg portion of the insulator and an inner circumferential surface of the ledge portion of the tubular metal shell being in communication with (i.e., connected to) the rear end surface and disposed radially outward of the cylindrical leg portion of the insulator. The third portion is disposed between the inner circumferential surface and the outer circumferential surface. The first portion, the second portion, and the third portion of the packing constrain the insulator, and it is therefore possible to enhance the effect of suppressing the eccentricity of the insulator relative to the metal shell, in addition to achieving the effect of the first aspect of the invention.

According to a third aspect of the invention, in the tubular metal shell of the spark plug, a protruding portion provided so as to extend from the rear end surface of the ledge portion to an inner circumferential surface of the ledge portion protrudes further in a direction orthogonal to the central axis than the inner circumferential surface of the ledge portion. A portion of the packing is disposed between the protruding portion and the insulator, and therefore, the force of constraint of the packing can be increased as compared with when the protruding portion is not provided. Thus, in addition to achieving the effect of the first and second aspects of the invention, it is possible to enhance the effect of suppressing the eccentricity of the insulator relative to the metal shell.

According to a fourth aspect of the spark plug, in a cross section including the central axis, a value obtained by dividing a height of the protruding portion from the inner circumferential surface of the ledge portion by a gap distance between the inner circumferential surface of the ledge portion and the outer circumferential surface of the cylindrical leg portion is 0.93 or less. Accordingly, it is possible to prevent the protruding portion from coming into contact with the insulator. Thus, in addition to achieving the effect of the third aspect of the invention, it is possible to achieve the effect of preventing damage caused to the insulator by contact of the protruding portion.

According to a fifth aspect of the invention, the metal shell of the spark plug includes a thread portion having a nominal diameter of 10 mm or less at least on an outer circumferential surface of the trunk portion. Although a spark plug including a thread portion having a nominal diameter of 10 mm or less tends to cause side spark when the eccentricity of the insulator relative to the metal shell becomes prominent, the eccentricity of the insulator relative to the metal shell can be suppressed by the packing. Thus, in addition to achieving the effect of the first through fourth aspects of the invention, it is possible to achieve the effect of suppressing side spark.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

Figure 1:
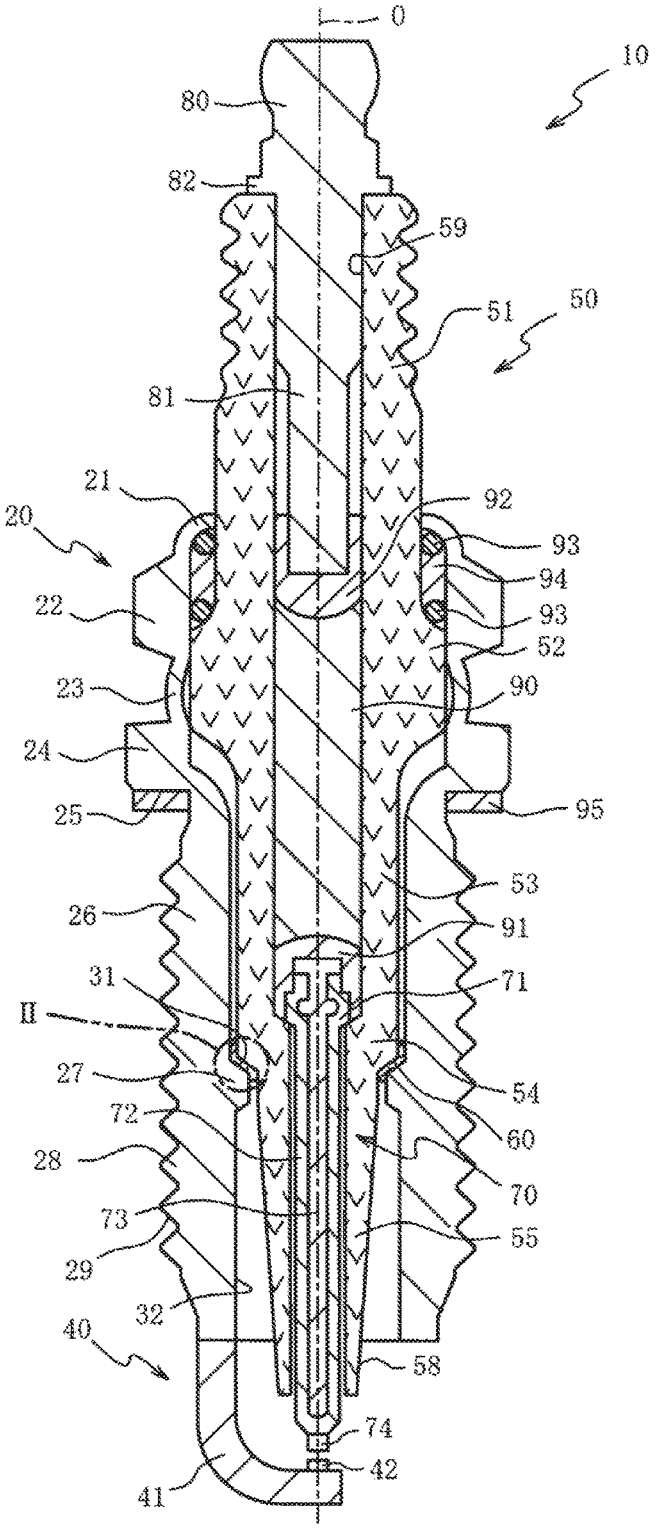
FIG. 1 is a cross-sectional view of a spark plug according to a first embodiment of the present invention.

Hereinafter, preferred embodiments of the present invention will be described with reference to the accompanying drawings. FIG. 1 is a cross-sectional view taken along a plane including a central axis O of a spark plug 10 according to a first embodiment of the present invention. In FIG. 1, the lower side of the plane of paper is referred to as the front side of the spark plug 10, and the upper side of the plane of paper is referred to as the rear side of the spark plug 10. As shown in FIG. 1, the spark plug 10 includes a metal shell 20, a ground electrode 40, an insulator 50, and a center electrode 70.

The metal shell 20 is a substantially cylindrical member that is fixed to a threaded hole (not shown) of an internal combustion engine, and is formed of a conductive metal material (e.g., low-carbon steel, etc). The metal shell 20 includes an end portion 21, a tool engagement portion 22, a groove portion 23, a seat portion 24, a trunk portion 26, a ledge portion 27, and a long leg portion 28 that are linked in this order from the rear side to the front side along the central axis O. The end portion 21 and the groove portion 23 are portions for crimping the insulator 50, and the tool engagement portion 22 is a portion for allowing a tool such as a wrench to engage therewith when the spark plug 10 is mounted to the internal combustion engine. In the present embodiment, the metal shell 20 is shaped by cold forging or the like.

The ledge portion 27 is a portion that projects radially inward of the trunk portion 26, and is formed to have an inner diameter smaller than the inner diameter of the trunk portion 26. The ledge portion 27 has a rear end surface 31 whose diameter is reduced from the rear side toward the front side. A thread portion 29 is formed on the outer circumferential surfaces of the trunk portion 26, the ledge portion 27, and the long leg portion 28, which are located on the front side relative to the seat portion 24. An annular gasket 95 is fitted between the seat portion 24 and the thread portion 29. The gasket 95 seals a gap between the metal shell 20 and the internal combustion engine by being sandwiched between a bearing surface 25 and the internal combustion engine (engine head) when the thread portion 29 is fitted into the threaded hole of the internal combustion engine.

The ground electrode 40 includes an electrode base member 41 made of metal (e.g., made of a nickel-based alloy) that is joined to the front end (end face of the long leg portion 28) of the metal shell 20, and a tip 42 that is joined to the front end of the electrode base member 41. The electrode base member 41 is a bar-shaped member that is bent toward the central axis O so as to intersect the central axis O. The tip 42 is a member formed of a noble metal such as platinum, iridium, ruthenium, or rhodium, or an alloy containing any of these noble metals as a main component, and is joined at a position intersecting the central axis O.

The insulator 50 is a substantially cylindrical member formed of alumina or the like having excellent mechanical characteristics and insulation properties under high temperatures. The insulator 50 includes a rear portion 51, a protruding portion 52, a tube portion 53, a step portion 54, and a leg portion 55 that are linked in this order from the rear side to the front side along the central axis O, and has an axial hole 59 extending therethrough along the central axis O. The insulator 50 is inserted in the metal shell 20, and the metal shell 20 is fixed to the outer circumference thereof. The rear end of the rear portion 51 and the front end of the leg portion 55 of the insulator 50 are each exposed from the metal shell 20. The leg portion 55 is disposed radially inward of the long leg portion 28 of the metal shell 20. An inner circumferential surface 32 of the long leg portion 28 and an outer circumferential surface 58 of the leg portion 55 oppose each other at a predetermined interval.

The protruding portion 52 is a portion that projects radially outward of the rear portion 51, and is disposed radially inward of the groove portion 23 of the metal shell 20. The tube portion 53 and the leg portion 55 are disposed radially inward of the trunk portion 26 and the long leg portion 28, respectively. An inner circumferential surface and an outer circumferential surface 57 (see FIG. 2) whose diameters are reduced toward the front side are formed on the step portion 54 located between the tube portion 53 and the leg portion 55.

The packing 60 is an annular plate member formed of a metal material such as a mild steel plate that is softer than the metal material forming the metal shell 20. The packing 60 is subjected to carburizing or carbonitriding as needed. When the end portion 21 of the metal shell 20 is crimped radially inward toward the insulator 50, the insulator 50 is pressed toward the ledge portion 27 of the metal shell 20 via ring members 93 and 93 disposed on the outer circumference of the rear portion 51 of the insulator 50 and a filler 94 such as talc sandwiched between the ring members 93 and 93. As a result, the packing 60 is plastically deformed by being sandwiched between the ledge portion 27 and the step portion 54 of the insulator 50. The packing 60 air-tightly closes the gap between the ledge portion 27 and the step portion 54.

The center electrode 70 is a bar-shaped electrode obtained by embedding, in an electrode base member formed in the shape of a bottomed tube, a core material 73 having thermal conductivity higher than that of the electrode base member. The core material 73 is formed of copper or an alloy containing copper as a main component. The center electrode 70 includes a head portion 71 disposed on the step portion 54 of the insulator 50, and a shaft portion 72 extending toward the front side along the central axis O.

The front end of the shaft portion 72 is exposed from the axial hole 59, and a tip 74 is joined thereto. The tip 74 is a columnar member formed of a noble metal such as platinum, iridium, ruthenium, and rhodium, or an alloy containing any of these noble metals as a main component, and opposes the tip 42 of the ground electrode 40 via a spark gap.

The metal terminal 80 is a bar-shaped member to which a high-voltage cable (not shown) is connected, and is formed of a conductive metal material (e.g., low-carbon steel, etc). The front side of the metal terminal 80 is disposed inside the axial hole 59 of the insulator 50.

A resistor 90 is a member for suppressing electric wave noise that occurs during sparking, and is disposed in the axial hole 59 between the metal terminal 80 and the center electrode 70. Conductive glass seals 91 and 92 are disposed between the resistor 90 and the center electrode 70, and between the resistor 90 and the metal terminal 80, respectively. The glass seal 91 is in contact with each of the resistor 90 and the center electrode 70, and the glass seal 92 is in contact with each of the resistor 90 and the metal terminal 80. As a result, the center electrode 70 and the metal terminal 80 are electrically connected via the resistor 90 and the glass seals 91 and 92.

The spark plug 10 is manufactured by, for example, the following method. First, the center electrode 70 is inserted from the rear portion 51 side of the axial hole 59 of the insulator 50. The tip 74 is joined to the front end of the shaft portion 72 of the center electrode 70. The center electrode 70 is disposed such that the head portion 71 is supported by the step portion 54 and a front end portion of the center electrode 70 is exposed from the front end of the axial hole 59.

Next, a raw material powder of the glass seal 91 is introduced from the axial hole 59, and charged around and on the rear side of the head portion 71. The raw material powder of the glass seal 91 charged in the axial hole 59 is pre-compressed by using a compression bar member (not shown). A raw material powder of the resistor 90 is charged onto a molded article of the raw material powder of the glass seal 91. The raw material powder of the resistor 90 charged in the axial hole 59 is pre-compressed by using a compression bar member (not shown). Then, a raw material powder of the glass seal 92 is charged onto the raw material powder of the resistor 90. The raw material powder of the glass seal 92 charged in the axial hole 59 is pre-compressed by using a compression bar member (not shown).

Thereafter, a front end portion 81 of the metal terminal 80 is inserted from the rear side of the axial hole 59, and the metal terminal 80 is disposed such that the front end portion 81 is in contact with the raw material powder of the glass seal 92. Then, for example, while heating is conducted to a temperature higher than the softening points of the glass components contained in the raw material powders, the metal terminal 80 is press-fitted until the front end surface of a projected portion 82 formed on the rear side of the metal terminal 80 comes into abutment with the rear end surface of the insulator 50, and an axial load is applied by the front end portion 81 to the raw material powders of the glass seals 91 and 92 and the resistor 90. As a result, the raw material powders are compressed and sintered, to form glass seals 91 and 92 and a resistor 90 inside the insulator 50.

Next, the packing 60 (ring-shaped member before being plastically deformed) is disposed on the rear end surface 31, to which the ground electrode 40 has been joined in advance, of the ledge portion 27 of the metal shell 20, and thereafter the insulator 50 is inserted in the axial direction from the end portion 21 side of the metal shell 20. After the ring member 93 and the filler 94 have been inserted between the end portion 21 and the insulator 50, the end portion 21 is pressed in the axial direction by a jig (not shown) including a recess conforming to the crimped shape of the end portion 21, thereby to bend the end portion 21 radially inward.

Thus, the metal shell 20 and the insulator 50 are fixed to each other. The groove portion 23 is buckled and bent by the load applied to the metal shell 20. As a result, the protruding portion 52 of the insulator 50 is pressed by the end portion 21 to the front side in the axial direction via the ring member 93 and the filler 94. Accordingly, the packing 60 is sandwiched between the step portion 54 of the insulator 50 and the ledge portion 27 of the metal shell 20. As a result, the packing 60 is plastically deformed, so that the packing 60 is closely adhered to the step portion 54 of the insulator 50 and the ledge portion 27 of the metal shell 20.

Thereafter, the tip 42 is joined to the electrode base member 41 of the ground electrode 40, and the electrode base member 41 is bent such that the tip 42 of the ground electrode 40 opposes the tip 74 of the center electrode 70 in the axial direction, to obtain a spark plug 10.

Figure 2:
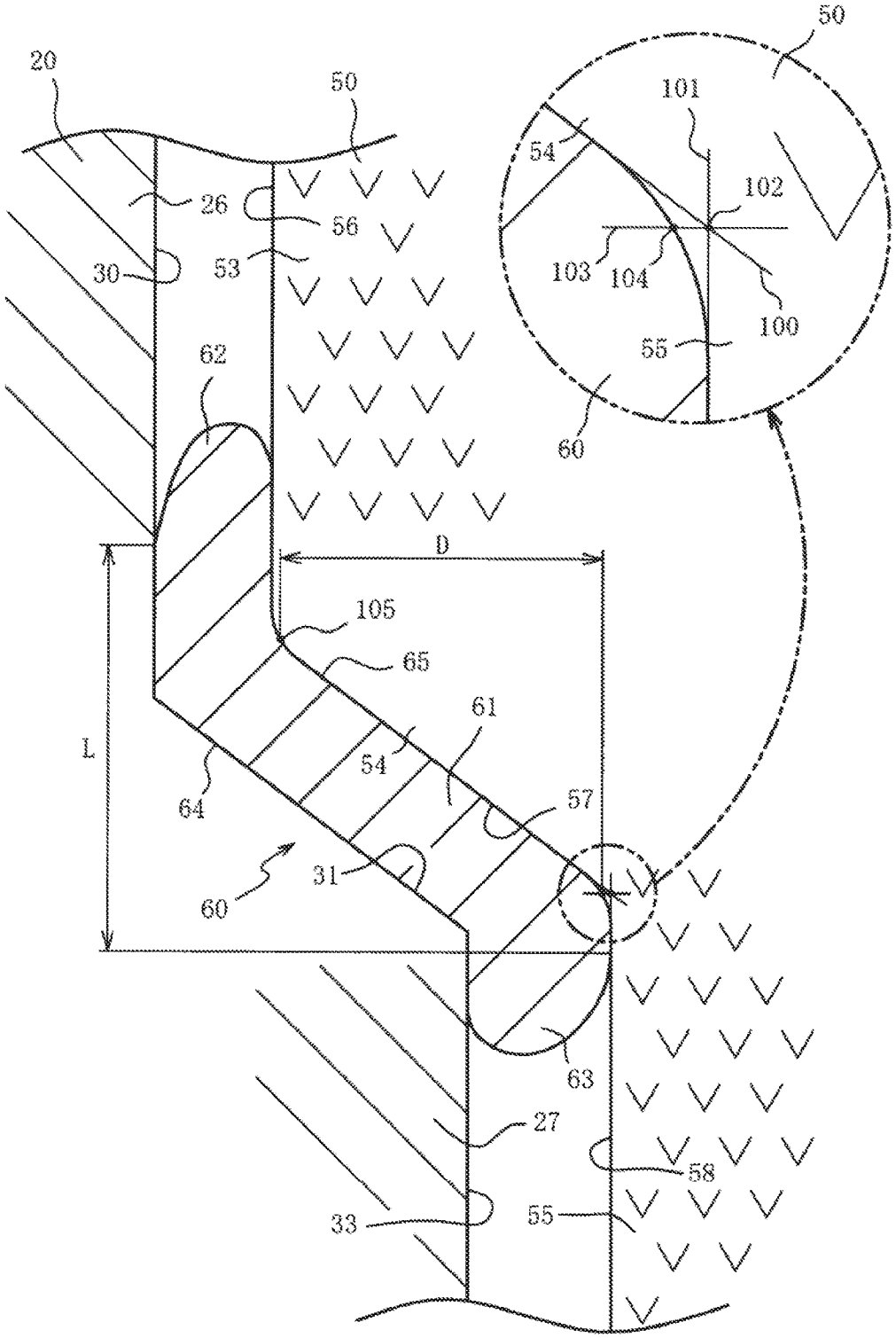
FIG. 2 is a cross-sectional view of the spark plug, showing a portion indicated by II in FIG. 1 in an enlarged manner.

The packing 60 will be described with reference to FIG. 2. FIG. 2 is a cross-sectional view including the central axis O of the spark plug 10, showing a portion indicated by II in FIG. 1 in an enlarged manner. In the metal shell 20, the inner circumferential surface 30 of the trunk portion 26 is connected to the rear end surface 31 of the ledge portion 27, and the rear end surface 31 of the ledge portion 27 is connected to the inner circumferential surface 33 of the ledge portion 27. The diameter of the rear end surface 31 of the ledge portion 27 is reduced toward the front side (the lower side in FIG. 2) of the metal shell 20. In the insulator 50, the outer circumferential surface 57 of the step portion 54 is connected to the outer circumferential surface 56 of the tube portion 53, and the outer circumferential surface 58 of the leg portion 55 is connected to the outer circumferential surface 57 of the step portion 54.

The diameter of the outer circumferential surface 57 of the step portion 54 is reduced toward the front side (the lower side in FIG. 2) of the insulator 50.

The packing 60 includes a first portion 61, a second portion 62, and a third portion 63. The first portion 61 is a portion that is in contact with the rear end surface 31 of the ledge portion 27 and the outer circumferential surface 57 of the step portion 54, and is disposed between the rear end surface 31 and the outer circumferential surface 57. The second portion 62 is a portion that is in contact with the inner circumferential surface 30 of the trunk portion 26 and the outer circumferential surface 56 of the tube portion 53, and is disposed between the inner circumferential surface 30 and the outer circumferential surface 56. The third portion 63 is a portion that is in contact with the inner circumferential surface 33 of the ledge portion 27 and the outer circumferential surface 58 of the leg portion 55, and is disposed between the inner circumferential surface 33 and the outer circumferential surface 58.

The first portion 61, the second portion 62, and the third portion 63 are portions formed by plastic deformation of the packing 60 when the metal shell 20 is assembled to the insulator 50, and the first portion 61, the second portion 62, and the third portion 63 are integrally formed. As a result of the second portion 62 and the third portion 63 being formed, a metal contact surface 64 on which the packing 60 is in contact with the metal shell 20 is formed on the metal shell 20 extending from the trunk portion 26 to the ledge portion 27. Likewise, a contact surface 65 on which the packing 60 is in contact with the insulator 50 is formed on the insulator 50 extending from the tube portion 53 to the leg portion 55.

A length L is an axial length of an overlap portion where the metal contact surface 64 overlaps a projection plane that is located on the metal shell 20 and on which the contact surface 65 is projected in a direction orthogonal to the central axis O (see FIG. 1). A portion of the packing 60 that corresponds to the overlap portion (the region of the length L) receives a compressive load resulting from vibration or the like when the insulator 50 moves in the radial direction relative to the metal shell 20, and thus constrains the radial movement of the insulator 50 relative to the metal shell 20. As the length L increases, the inclination of the axis of the insulator 50 relative to the metal shell 20 can be more effectively suppressed.

The packing 60 receives an axial load exerted by the step portion 54 on the insulator 50 and the metal shell 20. The area of the outer circumferential surface 57 of the step portion 54 affects the pressure applied to the packing 60 by the axial load exerted on the insulator 50 and the metal shell 20. When the magnitude of the axial load is the same, the smaller the area of the axial projection plane of the outer circumferential surface 57 of the step portion 54 is, the greater the pressure applied to the packing 60 by the axial load will be. The pressure applied to the packing 60 is vertically exerted on the rear end surface 31 of the ledge portion 27, and a component force in a direction orthogonal to the central axis O is exerted on the metal shell 20 and the insulator 50 as a force of constraint. The greater the pressure of the packing 60 is, or in other words, the smaller the radial length of the outer circumferential surface 57 of the step portion 54 is, the greater the force of constraint constraining the radial movement of the insulator 50 can be.

The radial length of the outer circumferential surface 57 of the step portion 54 is equal to a difference D between the radius of the outer circumference of the tube portion 53 at a connection position 105 to the step portion 54 and the radius of the outer circumference of the leg portion 55 at a connection position 104 to the step portion 54. In the present embodiment, the boundary between the outer circumferential surface 58 of the leg portion 55 and the outer circumferential surface 57 of the step portion 54, and the boundary between the outer circumferential surface 56 of the tube portion 53 and the outer circumferential surface 57 of the step portion 54 are each rounded, and therefore, the connection positions 104 and 105 are determined in the following manner. Note that the connection positions 104 and 105 are determined in the same manner. Therefore, the method for determining the connection position 104 will be described here, and the description of the method for determining the connection position 105 has been omitted.

First, an intersection point 102 between a line 100 that is extended from the outer circumferential surface 57 of the step portion 54 radially outward and a line 101 that is extended from the outer circumferential surface 58 of the leg portion 55 along the central axis O (see FIG. 1) is determined. Then, a perpendicular line 103 that passes through the intersection point 102 and is orthogonal to the central axis O is drawn, and an intersection point between the outer surface of the insulator 50 and the perpendicular line 103 is determined to be a connection position 104. When the boundary is chamfered, the connection position is determined in the same manner. When the boundary between the outer circumferential surface 58 of the leg portion 55 and the outer circumferential surface 57 of the step portion 54, or the boundary between the outer circumferential surface 56 of the tube portion 53 and the outer circumferential surface 57 of the step portion 54 has a corner (when the boundary is not rounded or chamfered), the corner of the boundary is the connection position.

The length L and the difference D are set in accordance with the dimension of the insulator 50, the size of the gap between the insulator 50 and the metal shell 20, the inclination of the rear end surface 31 of the metal shell 20 or the outer circumferential surface 57 of the insulator 50 relative to the central axis O, the thickness or the shape of the packing 60, the magnitude of the axial load on the insulator 50, and the like. The spark plug 10 is configured such that a value L/D obtained by dividing the length L by the difference D is 1.2 or more. By satisfying $L/D \geq 1.2$, it is possible to ensure the force of constraint in the radial direction provided by the packing 60 on the insulator 50. This makes it possible to suppress the eccentricity of the insulator 50 relative to the metal shell 20.

The packing 60 includes the second portion 62 entering between the trunk portion 26 and the tube portion 53, and the third portion 63 entering between the ledge portion 27 and the leg portion 55. The first portion 61, the second portion 62, and the third portion 63 of the packing 60 constrain the insulator 50, so that it is possible to ensure the axial length L of the overlap portion. The inclination of the axis of the insulator 50 relative to the central axis O (see FIG. 1) can be suppressed, and it is therefore possible to enhance the effect of suppressing the eccentricity of the insulator 50 relative to the metal shell 20.

Since the rear end portion 31 and the outer circumferential surface 57 are inclined relative to the central axis O, a component force, in a direction at right angles to the axis, of the load exerted in a direction perpendicular to these surfaces is exerted on the first portion 61. In contrast, the second portion 62 and the third portion 63 are disposed along the central axis O, and therefore, the force of constraint in a direction at right angles to the axis can be increased as compared with the first portion 61. Thus, it is possible to enhance the effect of suppressing the eccentricity of the insulator 50 relative to the metal shell 20.

If the eccentricity of the insulator 50 relative to the metal shell 20 can be suppressed, the interval between the inner circumferential surface 32 of the long leg portion 28 of the metal shell 20 and the outer circumferential surface 58 of the leg portion 55 of the insulator 50 can be made substantially equal over the entire circumference. As a result, it is possible to suppress side spark, for example, even for a small diameter spark plug 10 including a thread portion 29 having a nominal diameter of 10 mm or less. This is because side spark tends to occur at a place where the interval between the inner circumferential surface 32 of the long leg portion 28 and the outer circumferential surface 58 of the leg portion 55 is small.

Figure 3:
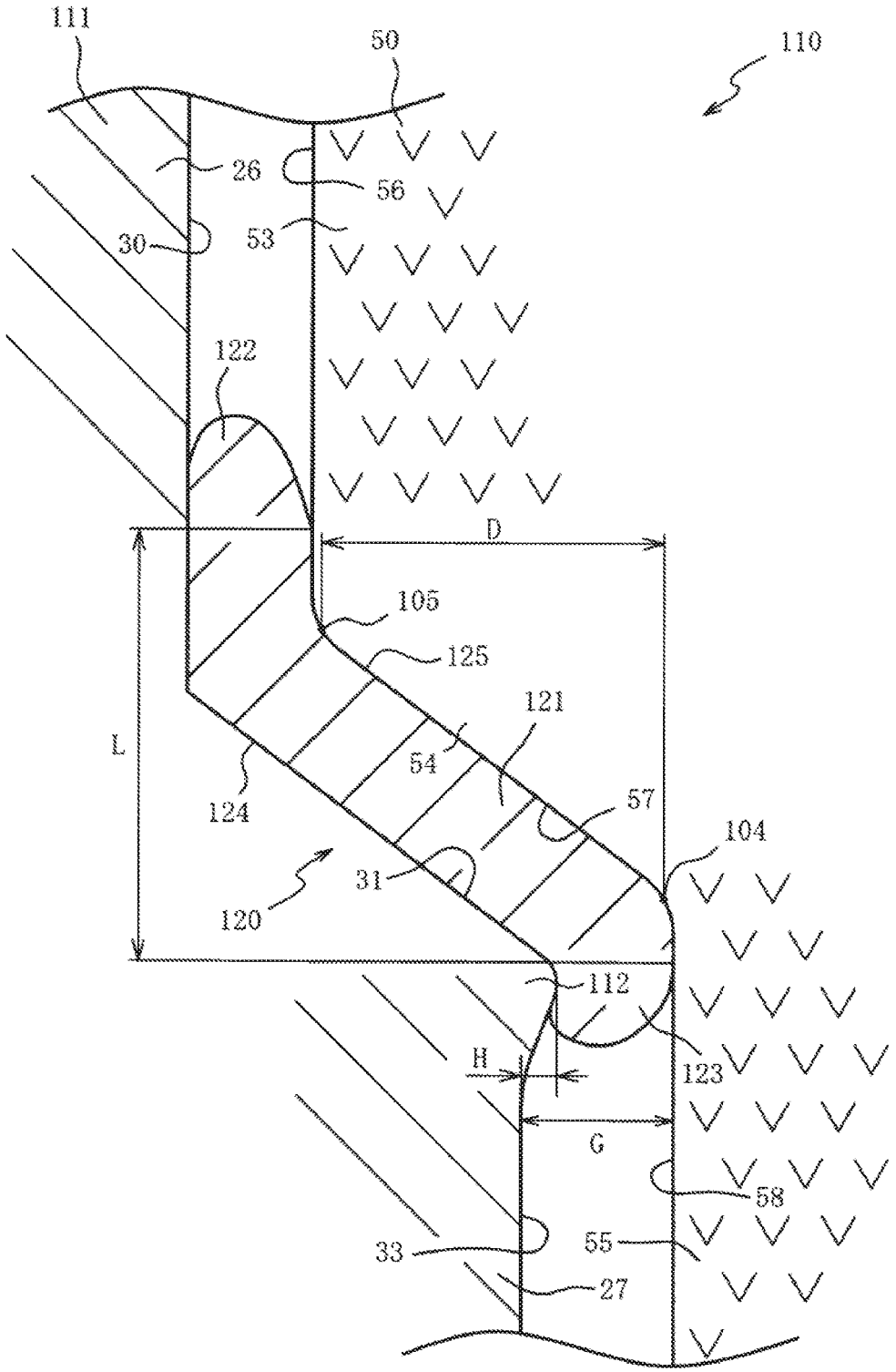
FIG. 3 is a cross-sectional view of a spark plug according to a second embodiment.

Next, a second embodiment will be described with reference to FIG. 3. In the second embodiment, a case will be described where a protruding portion 112 is formed at the boundary between the rear end surface 31 and the inner circumferential surface 33 of the ledge portion 27 of a metal shell 111. Note that the portions described in the first embodiment are denoted by the same reference numerals, and further description thereof has been omitted. FIG. 3 is a cross-sectional view including the central axis O of a spark plug 110 according to the second embodiment. FIG. 3 shows the vicinity of the ledge portion 27 of the metal shell 111 in an enlarged manner.

The spark plug 110 includes a metal shell 111 and an insulator 50. In the metal shell 111, the inner circumferential surface 30 of the trunk portion 26 is connected to the rear end surface 31 of the ledge portion 27, and the rear end surface 31 of the ledge portion 27 is connected to the inner circumferential surface 33 of the ledge portion 27. The diameter of the rear end surface 31 of the ledge portion 27 is reduced toward the front side (the lower side in FIG. 3) of the metal shell 111. A protruding portion 112 is formed at the boundary between the rear end surface 31 and the inner circumferential surface 33 of the ledge portion 27. The protruding portion 112 is present in an annular shape at the boundary between the rear end surface 31 and the inner circumferential surface 33 of the ledge portion 27. The protruding portion 112 is configured such that a height H from the inner circumferential surface 33 of the ledge portion 27 is 0.93 or less of a gap distance G between the inner circumferential surface 33 of the ledge portion 27 and the outer circumferential surface 58 of the leg portion 55.

Note that the outer shape of the metal shell 111 is formed by cold forging, and thereafter, the trunk portion 26 and the ledge portion 27 are formed by cutting work. Instead of cutting off the hardened portion created by cold forging from the metal shell 111, a cutting trace (not shown) is formed on the inner circumferential surface 30 of the trunk portion 26 and the rear end surface 31 of the ledge portion 27. At this point, the protruding portion 112 has not been formed.

The packing 120 includes a first portion 121, a second portion 122, and a third portion 123. The first portion 121 is a portion that is in contact with the rear end surface 31 of the ledge portion 27 and the outer circumferential surface 57 of the step portion 54, and is disposed between the rear end surface 31 and the outer circumferential surface 57. The second portion 122 is a portion that is in contact with the inner circumferential surface 30 of the trunk portion 26 and the outer circumferential surface 56 of the tube portion 53, and is disposed between the inner circumferential surface 30 and the outer circumferential surface 56.

The third portion 123 is a portion that is in contact with the protruding portion 112 and the outer circumferential surface 58 of the leg portion 55, and is disposed between the protruding portion 112 and the outer circumferential surface 58. The third portion 123 is in contact with the top (the portion at which the height H from the inner circumferential surface 33 is measured) of the protruding portion 112 and the outer circumferential surface 58 of the leg portion 55.

A method for assembling the insulator 50 to the metal shell 111 will be described. The packing 120 (ring-shaped member before being plastically deformed) is disposed on the rear end surface 31 of the ledge portion 27 of the metal shell 111 to which the ground electrode 40 (see FIG. 1) has been joined in advance, and thereafter, the insulator 50 is inserted in the metal shell 111. Then, the protruding portion 52 of the insulator 50 is pressed to the front side in the axial direction by the end portion 21 of the metal shell 111 via the ring member 93 and the filler 94, to press the packing 120 against the step portion 54 of the insulator 50 and the ledge portion 27 of the metal shell 111. As a result, the ledge portion 27 is plastically deformed to form the protruding portion 112, and the packing 120 is plastically deformed to form the first portion 121, the second portion 122, and the third portion 123, and is closely adhered to the step portion 54 and the ledge portion 27.

As a result of the first portion 121, the second portion 122, and the third portion 123 being formed integrally, a metal contact surface 124 on which the packing 120 is in contact with the metal shell 111 is formed on the metal shell 111 extending from the trunk portion 26 to the ledge portion 27. Likewise, a contact surface 125 on which the packing 120 is in contact with the insulator 50 is formed on the insulator 50 extending from the tube portion 53 to the leg portion 55. As in the first embodiment, the spark plug 110 is configured such that a value L/D obtained by dividing the axial length L of the overlap portion where a projection plane located on the metal shell 111 and on which the contact surface 125 is projected in a direction orthogonal to the central axis O (see FIG. 1) overlaps the metal contact surface 124, by the difference D, is 1.2 or more.

In the spark plug 110, the third portion 123 (a portion of the packing 120) is disposed between the protruding portion 112, which protrudes toward a direction orthogonal to the central axis O further than the inner circumferential surface 33 of the ledge portion 27, and the insulator 50. Accordingly, the force of constraint by the third portion 123 can be increased as compared with when the protruding portion 112 is not provided. In particular, since the third portion 123 is in contact with the top of the protruding portion 112 and the outer circumferential surface 58 of the leg portion 55, the force of constraint by the third portion 123 can be increased as compared with when the metal contact surface 124 does not include the top of the protruding portion 112.

The spark plug 110 is configured such that, in a cross section including the central axis O, a value H/G obtained by dividing the height H of the protruding portion 112 from the inner circumferential surface 33 of the ledge portion 27 by the gap distance G between the inner circumferential surface 33 of the ledge portion 27 and the outer circumferential surface 58 of the leg portion 55 is 0.93 or less. Accordingly, it is possible to prevent the protruding portion 112 from coming into contact with the insulator 50 during use. Since it is possible to prevent damage to the insulator 50 caused by the protruding portion 112, it is possible to achieve both an enhanced force of constraint by the packing 120 and a longer service life.

Figure 4:
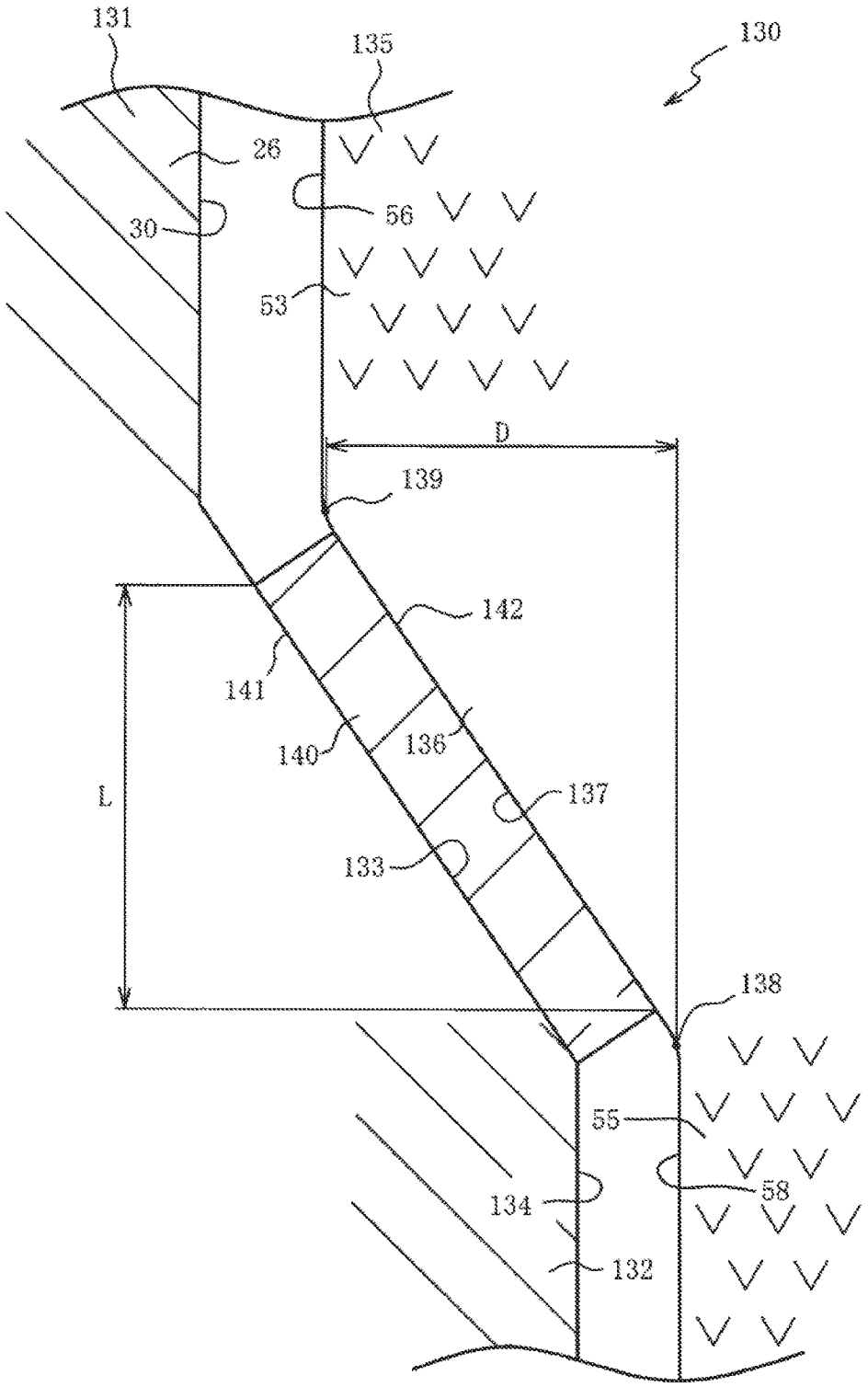
FIG. 4 is a cross-sectional view of a spark plug according to a third embodiment.

Next, a third embodiment will be described with reference to FIG. 4. The first embodiment and the second embodiment have described cases where the packings 60 and 120 include the second portions 62 and 122 and the third portions 63 and 123. In contrast, the third embodiment will describe a spark plug 130 including a packing 140 without a second portion or a third portion. Note that the portions described in the first embodiment are denoted by the same reference numeral, and further description thereof has been omitted. FIG. 4 is a cross-sectional view including the central axis O of the spark plug 130 according to a third embodiment. FIG. 4 shows the vicinity of a ledge portion 132 of a metal shell 131 in an enlarged manner.

The spark plug 130 includes a metal shell 131 and an insulator 135. In the metal shell 131, the inner circumferential surface 30 of the trunk portion 26 is connected to a rear end surface 133 of the ledge portion 132, and the rear end surface 133 of the ledge portion 132 is connected to an inner circumferential surface 134 of the ledge portion 132. The diameter of the rear end surface 133 of the ledge portion 132 is reduced toward the front side (the lower side in FIG. 4) of the metal shell 131. In the insulator 135, an outer circumferential surface 137 of a step portion 136 is connected to the outer circumferential surface 56 of the tube portion 53, and the outer circumferential surface 58 of the leg portion 55 is connected to the outer circumferential surface 137. The diameter of the outer circumferential surface 137 of the step portion 136 is reduced toward the front side (the lower side in FIG. 4) of the insulator 135.

The packing 140 is in contact with the rear end surface 133 of the ledge portion 132 and the outer circumferential surface 137 of the step portion 136, and disposed between the rear end surface 133 and the outer circumferential surface 137. A metal contact surface 141 on which the packing 140 is in contact with the metal shell 131 is formed on the metal shell 131 extending from the trunk portion 26 to the ledge portion 132. Likewise, a contact surface 142 on which the packing 140 is in contact with the insulator 135 is formed on the insulator 135 extending from the tube portion 53 to the leg portion 55.

As in the first embodiment, the spark plug 130 is configured such that a value L/D obtained by dividing the axial length L of an overlap portion where a projection plane located on the metal shell 131 and on which the contact surface 142 is projected in a direction orthogonal to the central axis O (see FIG. 1) overlaps the metal contact surface 141, by a difference D, is 1.2 or more. The difference D is a difference between the radius of the outer circumference of the tube portion 53 at a connection position 139 to the step portion 136 and the radius of the outer circumference of the leg portion 55 at a connection position 138 to the step portion 136. Since the spark plug 130 is configured such that L/D≥1.2, the same effect as that of the first embodiment can be achieved, except for the effect achieved by the second portion 62 and the third portion 63 of the packing 60.

EXAMPLES

The present invention will be described in further detail by way of examples. It should be noted, however, that the present invention is not limited to the examples.

Test Pieces 1 to 10

Test Pieces 1 to 10 were prepared by varying a ratio L/D of a length L of an overlap portion of a packing and a difference D for a spark plug including a thread portion formed on the outer circumference of a metal shell and having a nominal diameter of 10 mm (nominal M10). The difference D was set in accordance with the dimension of an insulator. The length L was set by varying the axial load applied at the time of assembling the metal shell to the insulator (at the time of crimping the metal shell). At the time of assembling the metal shell to the insulator, alignment was performed by using a jig (not shown) so as to reduce the distance (misalignment) between a central axis of the insulator and a central axis of the metal shell.

The axis misalignment was measured by using a three-dimensional measurement instrument. With each test piece being fixed to the three-dimensional measurement instrument, the probe of the three-dimensional measurement instrument was brought into contact with the front end of the inner circumferential surface of a long leg portion of the metal shell so as to detect the coordinates of the circle of the inner circumferential surface of the long leg portion, and central coordinates A of the long leg portion (inner circumferential surface) were calculated. Next, the probe was brought into contact with a portion, intersecting the circle of the long leg portion (inner circumferential surface), of the insulator of the leg portion so as to detect the coordinates of the circle of the outer circumferential surface of the leg portion, and central coordinates B of the leg portion (outer circumferential surface) were calculated. The position of the coordinates B relative to the position of the coordinates A, and the distance between the coordinates A and the coordinates B were recorded.

The length L was measured by non-destructive observation of a cross section including the central axis O by using an X-ray fluoroscopy device. In the cross section including the central axis O, the packing appears at two locations on opposite sides across the central axis O. Accordingly, an average of the two values for the packing appearing at the opposite sides of the central axis O was used as the value of L. As a result of the non-destructive observation, a first portion, a second portion, and a third portion were formed on the packing of each of Test Pieces 7 to 10 as described in the first embodiment.

Each test piece for which the length L and the axis misalignment had been measured was subjected to a vibration test, and the axis misalignment was measured again after the vibration test. The vibration test was performed with reference to ISO 11565 (2006) 3.4.4. As the vibration for vibrating the test piece, sine vibration with a frequency of 50 Hz to 500 Hz was swept at a rate of one octave per minute. The acceleration of the vibration was 30 G (294 $m/s^2$). In the test, vibration was applied for 48 hours in a direction orthogonal to the central axis of the test piece while repeatedly subjecting the test piece to a thermal cycle of increasing the temperature from 50° C. to 200° C. over 30 minutes, thereafter holding the temperature at 200° C. for 30 minutes, and cooling from 200° C. to 50° C. over one hour.

The distance (amount of axis misalignment) by which the coordinates B had been moved by the test was evaluated by comparing the position of the coordinates B relative to the coordinates A before the test with the position of the coordinates B relative to the coordinates A after the test. The test pieces having an amount of axis misalignment of 0.022 mm or less were evaluated as "good (o)" and the test pieces having an amount of axis misalignment exceeding 0.022 mm were evaluated as "poor (x)". The reference value 0.022 mm was determined from the standard value of axis misalignment at the time of assembling (crimping) the metal shell and the interval of an average±3σ (standard deviation) at that time. Table 1 shows L (mm), D (mm), L/D, the amount of axis misalignment (mm), and the evaluations of Test Pieces 1 to 10.

TABLE 1

| | L (mm) | D (mm) | L/D | Misalignment (mm) | Evaluation |
|---|---|---|---|---|---|
| Test Piece 1 | 0.512 | 0.775 | 0.66 | 0.034 | x |
| Test Piece 2 | 0.618 | 0.775 | 0.80 | 0.056 | x |
| Test Piece 3 | 0.610 | 0.775 | 0.79 | 0.088 | x |
| Test Piece 4 | 0.671 | 0.775 | 0.87 | 0.025 | x |
| Test Piece 5 | 0.765 | 0.775 | 0.99 | 0.085 | x |
| Test Piece 6 | 0.556 | 0.525 | 1.06 | 0.027 | x |
| Test Piece 7 | 0.630 | 0.525 | 1.20 | 0.020 | o |
| Test Piece 8 | 0.661 | 0.525 | 1.26 | 0.016 | o |
| Test Piece 9 | 0.710 | 0.525 | 1.35 | 0.015 | o |
| Test Piece 10 | 0.859 | 0.525 | 1.64 | 0.012 | o |

As shown in Table 1, all of Test Pieces 7 to 10, for which L/D≥1.2 was satisfied, met the criteria of the amount of axis misalignment. In contrast, Test Pieces 1 to 6, for which L/D<1.2, did not meet the criteria of the amount of axis misalignment. Since the test pieces are subjected to a thermal cycle in this test, the pressure applied to the packing during assembly of the metal shell is reduced as a result of the metal shell repeatedly undergoing expansion and contraction in the axial direction. Moreover, the test pieces are vibrated in a direction at right angles to the axis, and thus tend to cause axis misalignment.

In contrast, Test Pieces 7 to 10 are configured to satisfy L/D≥1.2, and, therefore, the pressure applied to the packing during assembly of the metal shell can be increased as compared with Test Pieces 1 to 6. Even when the pressure applied to the packing during assembly of the metal shell is reduced to some degree by the thermal cycle, it is possible to ensure the force of constraint provided by the packing on the insulator. It seems that this achieved a reduction in the amount of misalignment of the axes before and after the test.

Accordingly, even for a spark plug including a thread portion having a nominal diameter of 10 mm (nominal M10), axis misalignment over time after mounting the spark plug to an internal combustion engine can be suppressed, thus making it possible to suppress side spark that could be caused by axis misalignment.

Furthermore, the packing 60 (see FIG. 2) of each of Test Pieces 7 to 10 is provided with the first portion 61, the second portion 62, and the third portion 63. Accordingly, in addition to the first portion 61 in contact with the rear end surface 31 of the ledge portion 27 and the outer circumferential surface 57 of the step portion 54, the second portion 62 is in contact with the trunk portion 26 and the tube portion 53, and the third portion 63 is in contact with the inner circumferential surface 33 of the ledge portion 27 and the outer circumferential surface 58 of the leg portion 55. As a result, a force of constraint in a direction at right angles to the axis can be obtained by the second portion 62 and the third portion 63, thus making it possible to suppress of the axis misalignment of the insulator 50 relative to the metal shell 20.

Test Pieces 11 to 24

Test Pieces 11 to 24 were prepared by varying a ratio H/G of a height H of a protruding portion formed on the inner circumferential surface of a metal shell and a gap distance G between the metal shell and an insulator for a spark plug including a thread portion formed on the outer circumference of the metal shell and having a nominal diameter of 10 mm (nominal M10). The distance G was set in accordance with the dimensions of the metal shell and the insulator. The height H of the protruding portion was set by varying the axial load applied at the time of assembling the metal shell to the insulator (at the time of crimping the metal shell). At the time of assembling the metal shell to the insulator, alignment was performed by using a jig (not shown) so as to reduce the distance (misalignment) between the central axis of the insulator and the central axis of the metal shell.

The height H of the protruding portion and the distance G were measured by non-destructive observation of a cross section including the central axis O by using an X-ray fluoroscopy device. In the cross section including the central axis O, the protruding portion appears at two locations on opposite sides across the central axis O. Accordingly, an average of the two values for the protruding portion appearing at the opposite sides of the central axis O was used for each of the height H and the distance G.

The test pieces for which the height H and the distance G had been measured were subjected to the same vibration test performed on Test Pieces 1 to 10. Each of the test pieces after the test was examined by using an X-ray fluoroscopy device to determine whether any damage such as cracking had occurred to the insulator located in the vicinity of the protruding portion. The test pieces in which damage such as cracking had not occurred to the insulator were evaluated as "good (o)", and the test pieces in which damage such as cracking had occurred to the insulator were evaluated as "poor (x)". Table 2 shows H (mm), G (mm), H/G (%), and the evaluations of Test Pieces 11 to 24.

TABLE 2

| | H (mm) | G (mm) | H/G (%) | Evaluation |
|---|---|---|---|---|
| Test Piece 11 | 0.000 | 0.257 | 0.0 | o |
| Test Piece 12 | 0.012 | 0.251 | 4.8 | o |
| Test Piece 13 | 0.024 | 0.250 | 9.6 | o |
| Test Piece 14 | 0.061 | 0.253 | 24.1 | o |
| Test Piece 15 | 0.071 | 0.251 | 28.3 | o |
| Test Piece 16 | 0.059 | 0.279 | 21.1 | o |
| Test Piece 17 | 0.082 | 0.277 | 29.6 | o |
| Test Piece 18 | 0.082 | 0.267 | 30.7 | o |
| Test Piece 19 | 0.099 | 0.275 | 36.0 | o |
| Test Piece 20 | 0.144 | 0.279 | 51.6 | o |
| Test Piece 21 | 0.070 | 0.075 | 93.3 | x |
| Test Piece 22 | 0.231 | 0.246 | 93.9 | x |
| Test Piece 23 | 0.099 | 0.100 | 99.0 | x |
| Test Piece 24 | 0.217 | 0.218 | 99.5 | x |

As shown in Table 2, in all of Test Pieces 11 to 20, for which H/G≤0.93 was satisfied, damage such as cracking did not occur to the insulator. In contrast, in Test Pieces 21 to 24, for which H/G>0.93, damage such as cracking occurred to the insulator. It was found that although the axis misalignment between the metal shell and the insulator tends to occur during this test, Test Pieces 11 to 20, for which H/G≤0.93 was satisfied, were able to prevent the protruding portion from colliding with the insulator, thus making it possible to prevent damage to the insulator.

As a result of a portion of the packing being disposed between the protruding portion and the insulator, a pressure in the radial direction can be applied to the portion of the packing by the protruding portion. Since the force of constraint of the insulator can be increased by an amount of the pressure applied by the protruding portion, it is possible to further suppress the axis misalignment of the insulator relative to the metal shell.

Although the present invention has been described by way of embodiments, the present invention is by no means limited by the above embodiments, and it would be readily surmised that various improvements and modifications may be made thereto without departing from the scope and sprit of the present invention. For example, the shapes of the ground electrode 40 and the packing 60 are merely examples, and can be configured as appropriate. Likewise, the shapes and the sizes of the metal shell 20 and the insulator 50 are merely examples, and can be configured as appropriate.

Although the above embodiments have described cases where the ground electrode 40 and the center electrode 70 are provided with the tips 42 and 74, respectively, the present invention is not necessarily limited thereto. It is of course possible to omit the tips 42 and 74.

Although the above embodiments have described the spark plug 10 including the built-in resistor 90, the present invention is not necessarily limited thereto, and it is of course possible to omit the resistor 90. In this case, the metal terminal 80 and the center electrode 70 are joined by using the glass seal 91.

Although the above embodiments have described cases where the end portion 21 of the metal shell 20 crimps the insulator 50 via the ring member 93 and the filler 94, the present invention is not necessarily limited thereto. It is of course possible to omit the ring member 93 and the filler 94, and crimp the end portion 21 of the metal shell 20 to the protruding portion 52 of the insulator 50.

Although the first and second embodiments have described cases where the second portion 62 or 122 and the third portion 63 or 123 are formed on the packing 60 or 120, the present invention is not necessarily limited thereto. As long as the condition L/D≥1.2 is satisfied, either the second portion 62, 122 or the third portion 63, 123 may be omitted by appropriately configuring the shape, the size and the like of the packing. In this case as well, the condition L/D≥1.2 is satisfied, so that the force of constraint on the insulator 50 by the packing can be ensured, thus making it possible to suppress the axis misalignment between the metal shell 20 or 111 and the insulator 50.

DESCRIPTION OF REFERENCE NUMERALS

10, 110, 130: spark plug
20, 111, 131: metal shell
26: trunk portion
27, 132: ledge portion
29: thread portion
31, 133: rear end surface
33, 134: inner circumferential surface
40: ground electrode
50, 135: insulator
53: tube portion
54, 136: step portion
55: leg portion
56, 58: outer circumferential surface
60, 120, 140: packing
61, 121: first portion
62, 122: second portion
63, 123: third portion
64, 124, 141: metal contact surface
65, 125, 142: contact surface
70: center electrode
104, 105, 138, 139: connection position
112: protruding portion
D: difference
G: gap distance
H: height of protruding portion
L: length of overlap portion
O: central axis

What is claimed is:

1. A spark plug comprising:
an insulator including
a cylindrical tube portion disposed along a central axis and including an outer circumferential surface,
a cylindrical leg portion having an outer diameter smaller than an outer diameter of the cylindrical tube portion, and including an outer circumferential surface, and
a step portion including an outer circumferential surface connecting the outer circumferential surface of the cylindrical leg portion with the outer circumferential surface of the cylindrical tube portion;
a center electrode disposed inward of the insulator along the central axis;
a tubular metal shell including
a trunk portion disposed radially outward of the cylindrical tube portion of the insulator, and having a front end in an axial direction, and
a ledge portion linked to and projecting radially inward of the front end of the trunk portion, and including a rear end surface opposing the outer circumferential surface of the step portion of the insulator;
a packing disposed between the step portion and the ledge portion and defining
a metal contact surface where the packing is in contact with the tubular metal shell,
an insulator contact surface where the packing is in contact with the insulator, and
an overlap portion where the metal contact surface overlaps a projection plane located on the tubular metal shell where the insulator contact surface is projected in a direction orthogonal to the central axis; and
a ground electrode connected to the tubular metal shell and opposing the center electrode, wherein,
in a cross section including the central axis, a value obtained by dividing an axial length of the overlap portion by a difference between a radius of an outer circumference of the cylindrical tube portion at a connection position to the step portion and a radius of an outer circumference of the cylindrical leg portion at a connection position to the step portion, is 1.2 or more.

2. The spark plug according to claim 1, wherein
the ledge portion of the tubular metal shell further includes an inner circumferential surface connected to the rear end surface and disposed radially outward of the cylindrical leg portion of the insulator; and
the packing includes:
a first portion that is disposed between and is in contact with the rear end surface of the ledge portion of the tubular metal shell and the outer circumferential surface of the step portion of the insulator;
a second portion that is disposed between and is in contact with an inner circumferential surface of the trunk portion of the tubular metal shell and the outer circumferential surface of the cylindrical tube portion of the insulator; and
a third portion that is disposed between and is in contact with the outer circumferential surface of the cylindrical leg portion of the insulator and the inner circumferential surface of the ledge portion of the tubular metal shell.

3. The spark plug according to claim 1, wherein
the tubular metal shell further includes a protruding portion provided so as to extend from the rear end surface of the ledge portion to an inner circumferential surface of the ledge portion, and protruding further in a direction orthogonal to the central axis than the inner circumferential surface of the ledge portion, and
a portion of the packing is disposed between the protruding portion and the insulator.

4. The spark plug according to claim 3, wherein
in a cross section including the central axis, a value obtained by dividing a height of the protruding portion from the inner circumferential surface of the ledge portion by a gap distance between the inner circumferential surface of the ledge portion and the outer circumferential surface of the cylindrical leg portion is 0.93 or less.

5. The spark plug according to claim 1, wherein
the tubular metal shell includes a thread portion at least on an outer circumferential surface of the trunk portion, and
the thread portion has a nominal diameter of 10 mm or less.

* * * * *